US010395872B2

(12) United States Patent
Seo

(10) Patent No.: US 10,395,872 B2
(45) Date of Patent: Aug. 27, 2019

(54) MOVABLE CONTACT ASSEMBLY FOR CIRCUIT BREAKER

(71) Applicant: LSIS CO., LTD., Anyang-si, Gyeonggi-do (KR)

(72) Inventor: Min-Kyu Seo, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/946,249

(22) Filed: Apr. 5, 2018

(65) Prior Publication Data

US 2018/0294122 A1 Oct. 11, 2018

(30) Foreign Application Priority Data

Apr. 10, 2017 (KR) ..... 10-2017-0046209

(51) Int. Cl.
*H01H 71/10* (2006.01)
*H01H 71/24* (2006.01)
(Continued)

(52) U.S. Cl.
CPC ..... *H01H 71/1045* (2013.01); *H01H 1/226* (2013.01); *H01H 71/025* (2013.01);
(Continued)

(58) Field of Classification Search
CPC .. H01H 71/1045; H01H 1/226; H01H 77/104; H01H 71/025; H01H 71/2409;
(Continued)

(56) References Cited

U.S. PATENT DOCUMENTS 4,484,164 A * 11/1984 McClellan ..... H01H 1/18 200/244
5,793,270 A * 8/1998 Beck ..... H01H 77/104 218/154

(Continued)

FOREIGN PATENT DOCUMENTS

CN 102129942 A 7/2011
CN 202058671 U 11/2011

(Continued)

OTHER PUBLICATIONS

European Search Report for related European Application No. 18165469.0; report dated Sep. 6, 2018; (10 pages).

(Continued)

*Primary Examiner* — Ahmed M Saeed
(74) *Attorney, Agent, or Firm* — K&L Gates LLP

(57) ABSTRACT

According to an aspect of the present invention, there is provided a movable contact assembly for a circuit breaker, which includes a fixed contact, a connector formed to protrude from one side of a terminal connected to a load or a power source, a plurality of movable contacts pivotably installed at the connector through a connector pin and configured to be contactable to or separable from the fixed contact, a side holder pivotably installed at the connector through the connector pin, a catch pivotably installed at the connector, supported on the side holder, and configured to restrict a rebound phenomenon of the plurality of movable contacts when current limiting interruption occurs, and a pressurizing protrusion formed at a lower portion of each of the plurality of movable contacts and configured to push the catch when the current limiting interruption occurs.

8 Claims, 13 Drawing Sheets

(51) Int. Cl.

| | |
|---|---|
| ***H01H 71/02*** | (2006.01) |
| ***H01H 1/22*** | (2006.01) |
| ***H01H 77/10*** | (2006.01) |
| *H01H 71/50* | (2006.01) |

(52) U.S. Cl.
CPC ..... *H01H 71/2409* (2013.01); *H01H 77/104* (2013.01); *H01H 71/504* (2013.01); *H01H 2203/002* (2013.01); *H01H 2235/01* (2013.01)

(58) Field of Classification Search
CPC ..... H01H 71/504; H01H 2203/002; H01H 2235/01; H01H 71/1054; H01H 71/1072; H01H 71/1081; H01H 71/50; H01H 71/501; H01H 71/503; H01H 71/505
See application file for complete search history.

(56) References Cited

U.S. PATENT DOCUMENTS

| | | | | |
|---|---|---|---|---|
| 5,874,699 | A * | 2/1999 | Beck | H01H 71/501 200/244 |
| 6,337,449 | B1 | 1/2002 | Brouillat et al. | |
| 6,563,407 | B2 * | 5/2003 | Kramer | H01H 1/5833 200/244 |
| 9,299,518 | B2 * | 3/2016 | Biedunkiewicz | H01H 1/2041 |
| 9,330,859 | B2 * | 5/2016 | Biedunkiewicz | H01H 3/32 |
| 2009/0065341 | A1 * | 3/2009 | Shmukler | H01H 1/205 200/400 |
| 2017/0323751 | A1 * | 11/2017 | Sohn | H01H 71/0235 |
| 2018/0294122 | A1 * | 10/2018 | Seo | H01H 71/1045 |

FOREIGN PATENT DOCUMENTS

| | | | |
|---|---|---|---|
| CN | 106252169 | A | 12/2016 |
| KR | 101019030 | B1 | 3/2011 |
| KR | 20110085497 | A | 7/2011 |
| KR | 101079012 | B1 | 11/2011 |
| KR | 101141537 | B1 | 5/2012 |

OTHER PUBLICATIONS

Chinese Office Action for related Chinese Application No. 201810315103.5; action dated Mar. 22, 2019; (8 pages).

* cited by examiner

MOVABLE CONTACT ASSEMBLY FOR CIRCUIT BREAKER

CROSS-REFERENCE TO RELATED APPLICATION

Pursuant to 35 U.S.C. § 119(a), this application claims the benefit of earlier filing date and right of priority to Korean Application No. 10-2017-0046209, filed on Apr. 10, 2017, the disclosure of which is incorporated herein by reference in its entirety.

BACKGROUND

1. Field of the Invention

The present invention relates to a movable contact assembly for a circuit breaker, and more particularly, to a movable contact assembly for a circuit breaker in which a pressurizing protrusion for pushing a catch is provided at each of movable contact fingers and thus, when current limiting interruption occurs in any one of the movable contact fingers, reinputting of the movable contact fingers is prevented such that blocking thereof is stably kept.

2. Discussion of Related Art

Generally, circuit breakers are electrical devices which are installed at a power transmission site, a power substation, or an electrical circuit to cut off a circuit when a load is opened or closed, the ground is performed, or an accident such as a short circuit or the like occurs. An air circuit breaker among such circuit breakers is a circuit breaker which uses air as an extinguishing medium and is mainly employed for a low voltage device, and a movable contact assembly of a circuit breaker according to the present invention may be applied to the air circuit breaker and the like.

Interruption types of circuit breakers includes delay trip (demonstration trip) interruption for preventing overheating when an overcurrent flows (e.g., 1 to 1.5 times a rated current), and instantaneous trip interruption when a fault current (e.g., several to 10 times the rated current) occurs. The instantaneous trip interruption includes interruption caused by the mechanical action of an over current relay or a switching mechanism (instantaneous interruption in a general sense), and current limiting interruption caused by an electromagnetic repulsive force between a fixed contact and a movable contact.

The current limiting interruption is performed to immediately separate the movable contact from the fixed contact using the electromagnetic repulsive force generated between the movable contact and the fixed contact when a large current such as a short-circuit current flows, thereby cutting off a circuit to protect the circuit and a load, and a circuit breaker employing the current limiting interruption may be referred to as a current limiting circuit breaker.

FIG. 1 is an exploded perspective view of a movable contact assembly of a circuit breaker according to a related art. This related art refers to Korean Registered Patent No. 10-1079012 entitled "Current Limiting Circuit Breaker for Electric Wiring." A mover (movable contact) assembly 100 of a circuit breaker for electric wiring includes a terminal 180 formed of a conductive material and installed inside the circuit breaker, a connector 170 protruding from one side of the terminal 180, a movable contact 110 assembled to the connector 170 through a pin 200 and provided to be pivoted relative to the connector 170 at a predetermined angle, a side holder 120 provided at both sides of the movable contact 110, assembled to the connector 170 through the pin 200, and configured to adjust a position of the movable contact 110, a movable contact holder 125 coupled above the side holder 120 and configured to support a guide 115 of the movable contact 110, a link 126 and a link pin 127 which are installed at the movable contact holder 125 and configured to transmit power of a switching mechanism, a spring holder 130 fixed to the side holder 120 and configured to accommodate an upper portion of a spring 140 and apply a constant load when the movable contact 110 is pivoted, a latch 150 assembled to the side holder 120 and configured to be pivoted within a predetermined section, a roller 155 pivotably coupled to the latch 150, and a catch 160 pivotably installed at the terminal 180 and configured to restrict pivoting of the movable contact 110.

Here, the catch 160 is provided to prevent a phenomenon (rebound phenomenon) in which the movable contact 110 returns by colliding with a case or base mold (not shown) after being separated from a stator due to current limiting interruption. That is, the catch 160 prevents a reinputting of the movable contact 110 into the stator 210 during the current limiting interruption. When interruption by the mechanical action of the switching mechanism is performed, the movable contact holder 125 is moved together with the movable contact 110 such that a phenomenon in which the movable contact 110 rebounds independently may not occur, but when current limiting interruption is performed, the movable contact 110 is separated from the movable contact holder 125 and is moved independently such that there is a probability in which the movable contact 110 is input again due to a rebound phenomenon and thus the catch 160 is provided to prevent the reinputting of the movable contact 110.

In the related art, however, the action of the catch 160 becomes operable only when all movable contacts 110 (two movable contacts in FIG. 1) are moved together therewith. The aforementioned will be described in detail with reference to FIG. 2.

Two movable contacts 110 will be distinguished and referred to as a first movable contact 111 and a second movable contact 112. Catch recesses 111*a* and 112*a* are respectively formed at lower portions of the first movable contact 111 and the second movable contact 112.

When both the first movable contact 111 and the second movable contact 112 are separated from the stator 210 due to current limiting interruption, the catch recesses 111*a* and 112*a* are moved upward to a position at which a protruding contact part is formed on an upper surface of the catch 160 (to a position of the first movable contact 111 in FIG. 2). Since the catch 160 receives a counterclockwise force due to the action of a torsion spring 165, the catch 160 is inserted into the catch recesses 111*a* and 112*a* of the first movable contact 111 and the second movable contact 112 to restrict clockwise pivots of the first movable contact 111 and the second movable contact 112, such that the reinputting of the first movable contact 111 and the second movable contact 112 are prevented.

As shown in FIG. 2, however, when the second movable contact 112 is kept in the input state and only the first movable contact 111 is opened, that is, when any one of the first movable contact 111 and the second movable contact 112 is not opened, the catch 160 interferes with a non-opened movable contact (the second movable contact 112 in FIG. 2) and thus is prevented from being input into the catch recesses 111*a* and 112*a* such that an effect of preventing a reinputting cannot be achieved.

SUMMARY OF THE INVENTION

The present invention is directed to a movable contact assembly for a circuit breaker in which, when current limiting interruption occurs, a catch operates to prevent a reinputting of any one of movable contacts.

According to an aspect of the present invention, there is provided a movable contact assembly for a circuit breaker, which includes a fixed contact, a connector formed to protrude from one side of a terminal connected to a load or a power source, a plurality of movable contacts pivotably installed at the connector through a connector pin and configured to be contactable to or separable from the fixed contact, a side holder pivotably installed at the connector through the connector pin, a catch pivotably installed at the connector, supported on the side holder, and configured to restrict a rebound phenomenon of the plurality of movable contacts when current limiting interruption occurs, and a pressurizing protrusion formed at a lower portion of each of the plurality of movable contacts and configured to push the catch when the current limiting interruption occurs.

A latch may be pivotably installed at an intermediate portion of the side holder, a latch support to which the latch is contactable may be formed to protrude from one side of the lower portion of each of the plurality of movable contacts, and the pressurizing protrusion may be formed at a lower portion of the latch support.

The pressurizing protrusion may be formed in a triangular shape.

In an opened state, a lower surface of the pressurizing protrusion may be formed in a horizontal surface and an oblique surface thereof may be formed in an inclined surface.

An angle of the oblique surface may be formed in a range of 30 to 60 degrees relative to the lower surface.

The catch may include a base plate formed to have a length across the connector, a side plate formed to be bent on both sides of the base plate, a hook portion protruding from an upper portion of the base plate, and a hook protrusion protruding from an upper end of the side plate.

A circumferential protrusion and a circumferential recess may be formed along a circumferential surface at a lower end of the side holder.

An angle between the hook protrusion and an upper end of the circumferential protrusion based on the connector pin may be greater than an angle between the hook portion and the pressurizing protrusion based on the connector pin. In an input state, the hook portion may be positioned inside a pivotal circumferential surface of the pressurizing protrusion.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, preferred embodiments of the present invention will be described with reference to the accompanying drawings, the description is intended to fully illustrate the present invention so as to those skilled in the art to easily implement the present invention and it does not mean that the technical idea and scope of the present invention are limited.

Figure 1:
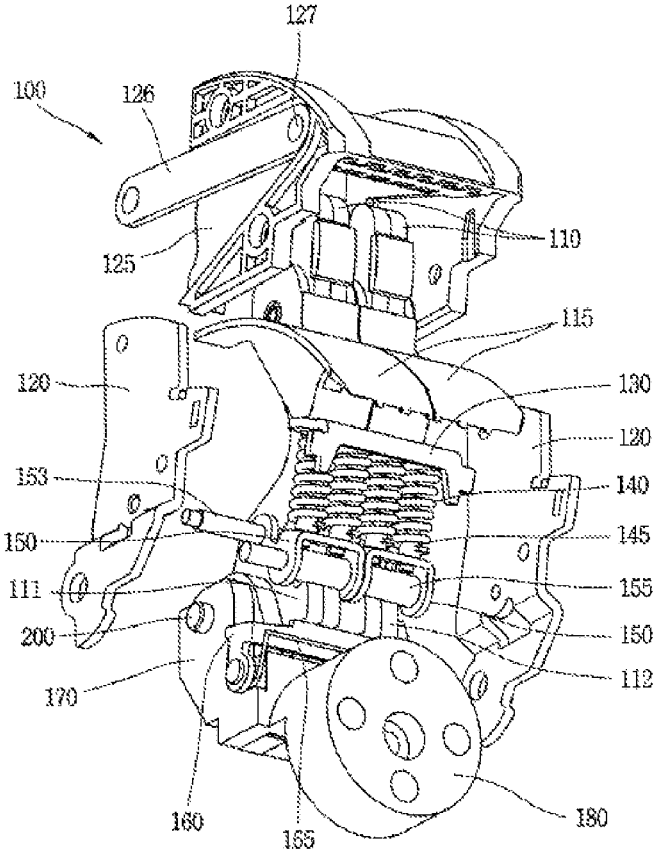
FIG. 1 is an exploded perspective view of a movable contact assembly of a circuit breaker according to a related art.
Figure 2:
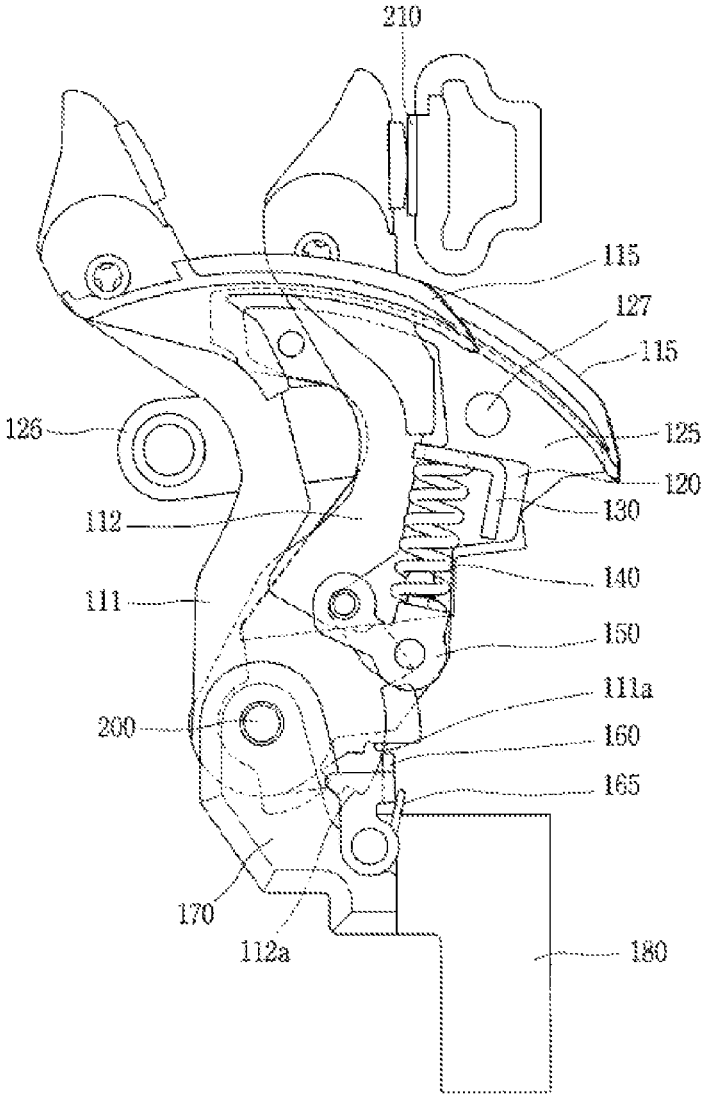
FIG. 2 is an operational diagram of the movable contact assembly for a circuit breaker according to the related art.
Figure 3:
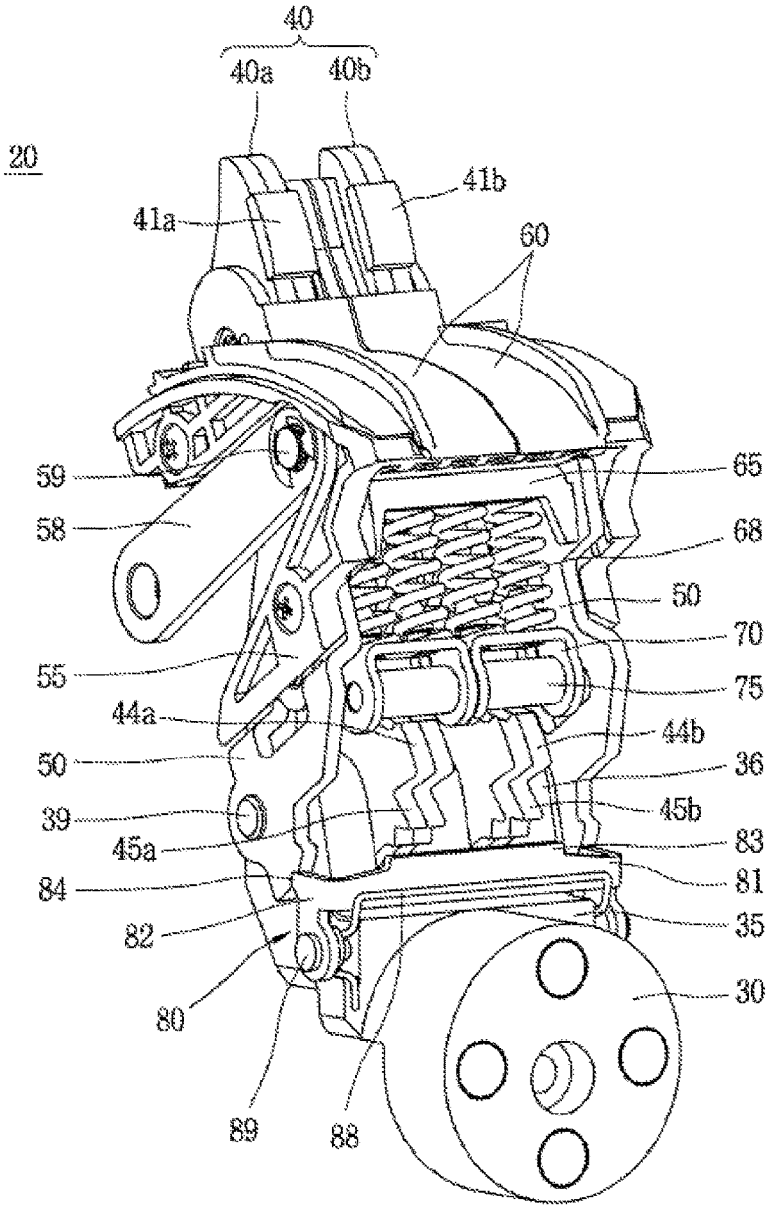
FIG. 3 is a perspective view of a movable contact assembly for a circuit breaker according to one embodiment of the present invention.
Figure 4:
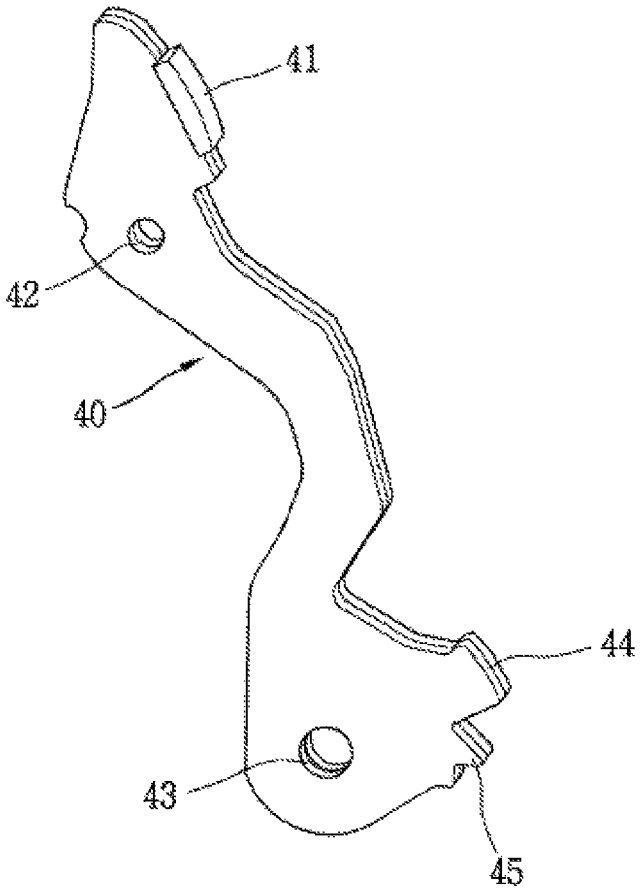
FIG. 4 is a perspective view of a movable contact applied to a mover of a current limiting circuit breaker according to one embodiment of the present invention.
Figure 5:
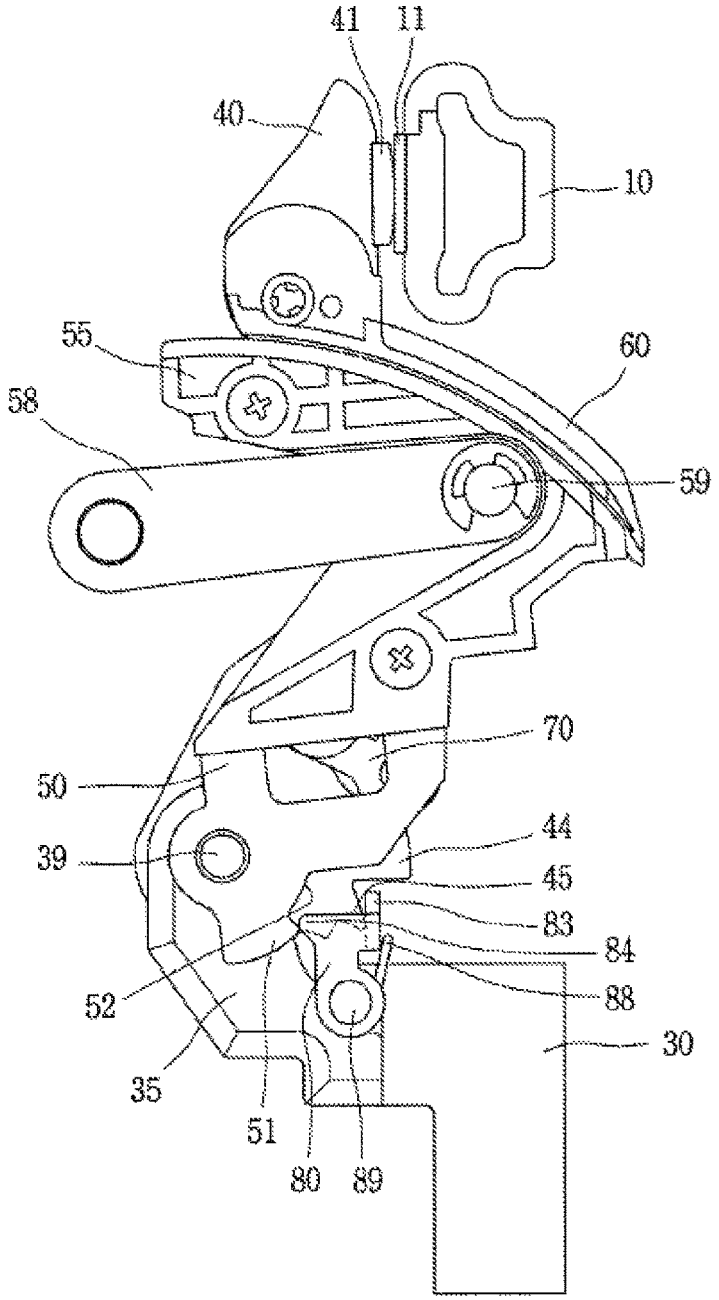
FIGS. 5 and 6 are operational diagrams when mechanical interruption is performed in the movable contact assembly for a circuit breaker according to one embodiment of the present invention and illustrate an input state and an opened state.
Figure 6:
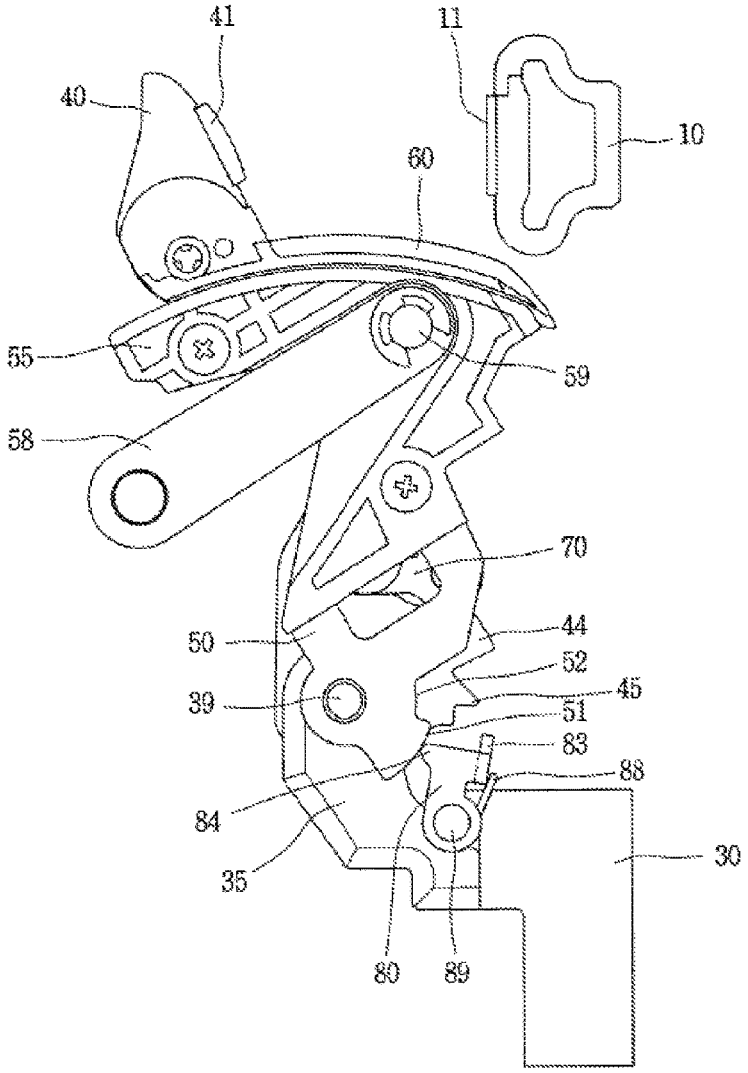

FIG. 3 is a perspective view of a movable contact assembly for a circuit breaker according to one embodiment of the present invention, FIG. 4 is a perspective view of a movable contact applied to a mover of a current limiting circuit breaker according to one embodiment of the present invention, and FIGS. 5 and 6 are operational diagrams of the movable contact assembly for a circuit breaker according to one embodiment of the present invention and illustrate an input state and an opened state. A movable contact assembly for a circuit breaker according to each embodiment of the present invention will be described in detail with reference to the drawings.

A movable contact assembly 20 of a circuit breaker according to one embodiment of the present invention includes a fixed contact 10, a connector 35 formed to protrude from one side of a terminal 30 connected to a load or a power source, a plurality of movable contacts 40 pivotably installed at the connector 35 through a connector pin 39 and configured to be contactable to or detachable from the fixed contact 10, a side holder 50 pivotably installed at the connector 35 through the connector pin 39, a catch 80 pivotably installed at the connector 35, supported on the side holder 50, and configured to restrict a rebound phenomenon of the plurality of movable contacts 40 when current limiting interruption is performed, and a pressurizing protrusion 45 formed at a lower portion of each of the plurality of movable contacts 40 and configured to push the catch 80 when current limiting interruption is performed.

The fixed contact 10 may be in the form of a roughly "U" shape (see FIG. 5). Accordingly, a current flowing into the fixed contact 10 may be formed in a direction opposite to that of a current flowing into the plurality of movable contacts 40. A fixed contact tip 11 is provided at a front surface of the fixed contact 10.

The movable contact assembly 20 may include the terminal 30, the connector 35, the plurality of movable contacts 40, the side holder 50, an upper holder 55, a spring holder 65, a latch 70, and the catch 80.

The terminal 30 is formed of a conductive material and is fixedly coupled to a terminal of a power source or load (not shown).

The connector 35 protrudes from one side of the terminal 30 and has a fork-shaped connecting part 36 such that the plurality of movable contacts 40 may be coupled to the connector 35. The connector 35 may integrally be formed with the terminal 30.

Each of the plurality of movable contacts 40 (also referred to as a movable contact finger) is pivotably coupled to the connecting part 36 of the connector 35 through the connector pin 39. Here, the plurality of movable contacts 40 are provided. In the present embodiment, an example configured with two movable contacts is shown. In this case, each of the two movable contacts is distinguished and referred to as a first movable contact 40*a* and a second movable contact 40*b*. When movable contacts are required to be distinguished from each other, suffix delimiters "a" and "b" will be added thereto. When the matters which are generally applied to movable contacts are described, the movable contacts are collectively referred without adding separate delimiters thereto.

A movable contact tip 41 is provided at one side of an upper portion of each of the plurality of movable contacts 40. A guide coupling hole 42 to which a movable contact guide 60 may be coupled is formed at the upper portion of each of the plurality of movable contacts 40. A pin hole 43 to which the connector pin 39 may be coupled is formed at a lower portion of each of the plurality of movable contacts 40. A latch support 44 with which a roller 75 of the latch 70 may be in contact is formed to protrude from one side of the lower portion of each of the plurality of movable contacts 40. The pressurizing protrusion 45 may be formed to protrude from a lower portion of the latch support 44 to come into contact with the catch 80.

The pressurizing protrusion 45 may be formed in a triangular shape. In an opened state, a lower surface of the pressurizing protrusion 45 may be formed in a horizontal surface and an oblique surface thereof may be formed in an inclined surface. Here, an angle of the oblique surface may be formed within the range of 30 degrees to 60 degrees relative to the lower surface. Consequently, the pressurizing protrusion 45 has a mechanical shape capable of easily pushing the catch 80, concentrating a force on a corner portion, preventing a malfunction.

A pair of side holders 50 are provided and coupled to both sides of the connecting part 36. A lower portion of each of the pair of side holders 50 is pivotably coupled to the connecting part 36 through the connector pin 39. Uneven parts 51 and 52 are formed along a circumferential surface of a lower end of each of the pair of side holders 50 (see FIGS. 5 and 6). That is, a circumferential protrusion 51 and a circumferential recess 52 are formed at the lower end of each of the pair of side holders 50.

The upper holder 55 is coupled to an upper portion of each of the pair of side holders 50. Each of the pair of side holders 50 supports and guides each of the plurality of movable contacts 40 and the movable contact guide 60.

A link 58 and a link pin 59 are installed at each of the pair of upper holders 55 to input or open each of the plurality of movable contacts 40 by a force transmitted from the switching mechanism (not shown). A pair of links 58 are provided and installed both sides of each of the pair of upper holders 55, and the link pin 59 is installed to pass through the pair of links 58 and the pair of upper holders 55. A switching drive force transmitted from the switching mechanism pushes or pulls the pair of upper holders 55 via the pair of links 58 and the link pin 59 to move the plurality of movable contacts 40 of the movable contact assembly 20.

The movable contact guide 60 is coupled to engaged with each of movable contacts 40*a* and 40*b* to support the movable contacts 40*a* and 40*b*, and simultaneously, guide a movement of each of the movable contacts 40*a* and 40*b*. The movable contact guide 60 slidably moves along the upper surface of each of the pair of upper holders 55 to guide the movable contact 40.

The spring holder 65 is fixed to one side of each of the pair of side holders 50 and supports an upper end of a spring 68.

The latch 70 is pivotably installed at an intermediate portion of each of the pair of side holders 50 and supports a lower end of the spring 68. The roller 75 may be provided at the latch 70. When the roller 75 receives a force by a movement of the movable contact 40 to move the latch 70 upward, the spring 68 is pressurized to further promote the movement of the movable contact 40. Consequently, an opening speed of the movable contact 40 increases.

The catch 80 is pivotably installed at the connector 35 through a catch pin 89. The catch 80 includes a base plate 81 formed to have a length across the connecting part 36 of the connector 35, a side plate 82 formed to be bent at both sides of the base plate 81, a hook part 83 protruding from an upper portion of the base plate 81, and a hook protrusion 84 protruding from an upper end of the side plate 82.

The catch 80 may be pivoted around the catch pin 89. A torsion spring 88 is installed at the catch pin 89 of the catch 80 to act a force for pivoting the catch 80 in a counterclockwise (an opening direction).

The catch 80 may be supported such that the hook protrusion 84 comes into contact with the uneven parts 51 and 52 of lower circumferential surfaces of the pair of side holders 50.

A switching operation performed by the switching mechanism will be described with reference to FIGS. 5 and 6. When inputting and blocking is performed by the switching mechanism, the upper holder 55 and the side holder 50 are moved together with the movable contact 40.

As shown in FIG. 5, during inputting, the link pin 59 pushes the upper holder 55 by a force of the switching mechanism, which is transmitted via the link 58. The side holder 50 is pivoted in the clockwise direction together with the upper holder 55 such that the circumferential recess 52 of the side holder 50 reaches at a position at which the hook protrusion 84 of the catch 80 is provided. At this point, the catch 80 is pivoted in the counterclockwise direction by an elastic force of the torsion spring 88, and thus the hook protrusion 84 is inserted into the circumferential recess 52.

As shown in FIG. 6, during opening, the link pin 59 pulls the upper holder 55 by a force of the switching mechanism, which is transmitted via the link 58. The side holder 50 is pivoted in the counterclockwise direction together with the upper holder 55 such that the circumferential protrusion 51 of the side holder 50 comes into contact with the hook protrusion 84 of the catch 80 to push the catch 80. Therefore, the catch 80 is pivoted in the clockwise direction around the catch pin 89 and an elastic force is stored in the torsion spring 88.

Figure 7:
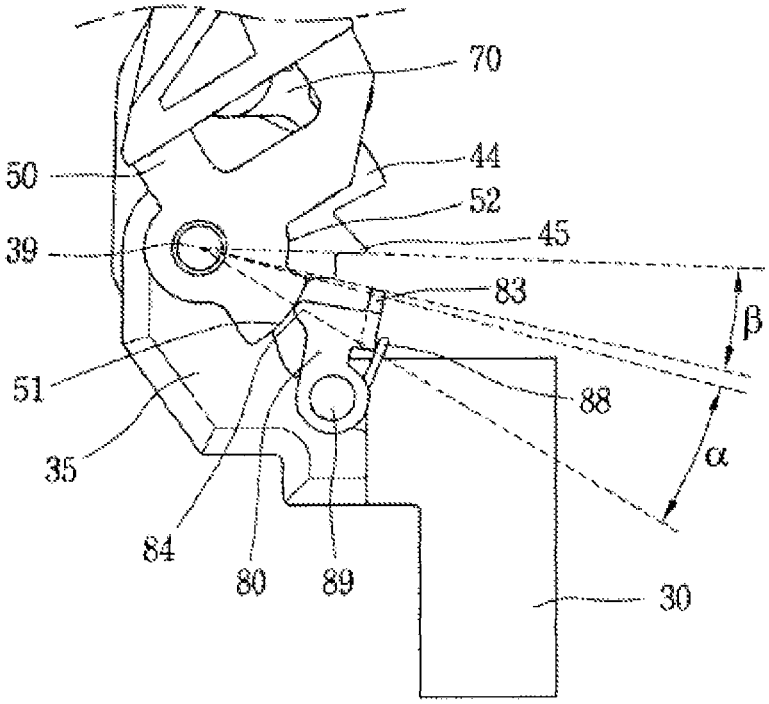
FIG. 7 is a partially detailed diagram of FIG. 6.

During opening, as the side holder 50 is pivoted in the counterclockwise direction, the circumferential protrusion 51 pushes the catch 80 and thus the catch 80 is pivoted in the clockwise direction. At this point, the hook part 83 of the catch 80 is in a state of having been moved to the outside (a rear side) and, the catch 80 does not interfere with the movement of the movable contact 40 when the catch 80 is input. The aforementioned will be described in detail with reference to FIG. 7. In an opened state, an angle $\alpha$ between the hook protrusion 84 of the catch 80 and the upper end of the circumferential protrusion 51 of the side holder 50 based on the connector pin 39 is greater than an angle $\beta$ between the hook part 83 of the catch 80 and the pressurizing protrusion 45 of the movable contact 40 based on the connector pin 39. Therefore, when the catch 80 is input, the pressurizing protrusion 45 of the movable contact 40 is input into an interior of the hook part 83 of the catch 80 before the hook protrusion 84 of the catch 80 escapes from the circumferential protrusion 51 of the side holder 50. That is, when the movable contact assembly 20 in normally input by the switching mechanism, the movable contact 40 does not interfere with the catch 80. However, after the inputting is completed, an inner surface of the base plate 81 of the catch 80 is placed at a position in contact with the pressurizing protrusion 45 of the movable contact 40.

Figure 8:
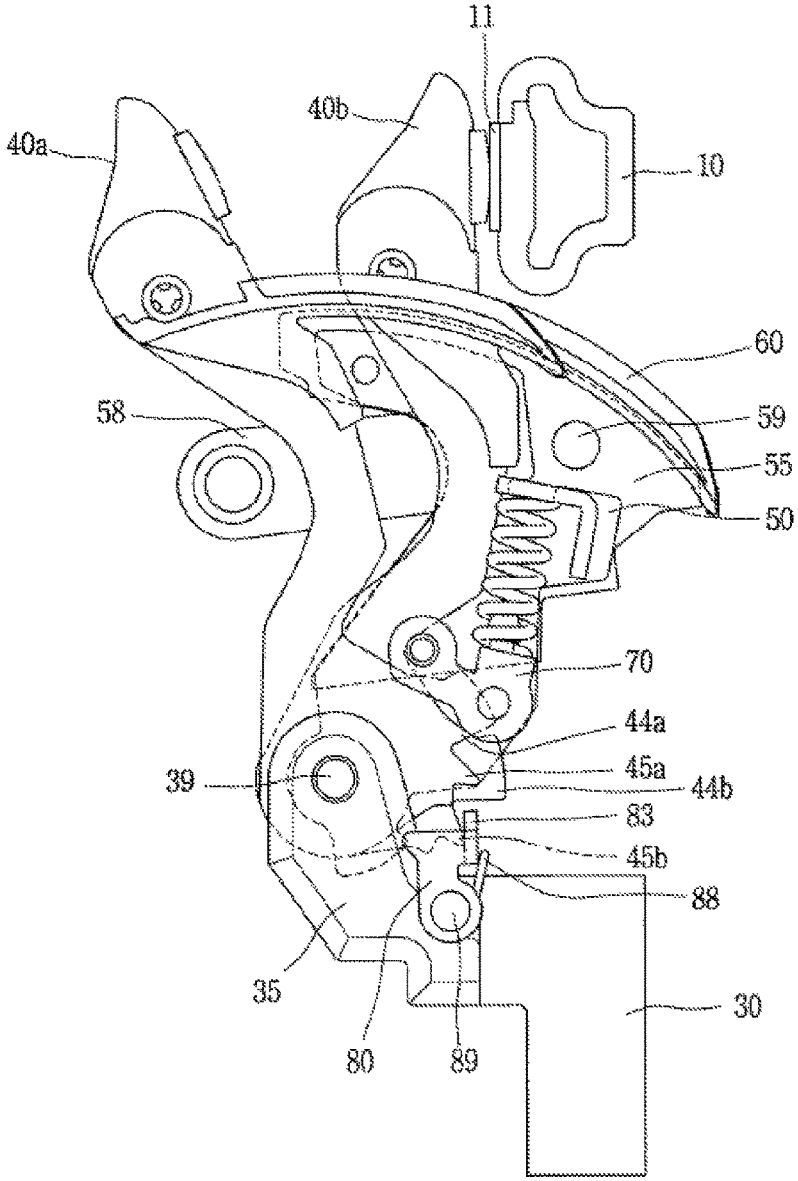
FIG. 8 is an operational diagram of a movable contact for a current limiting circuit breaker according to one embodiment of the present invention and illustrates a current limiting state in which one of movable contacts is blocked.

FIG. 8 is an operational diagram of a movable contact for a current limiting circuit breaker according to one embodiment of the present invention and illustrates a current limiting state. Only one of movable contacts is in a blocked state. For example, the first movable contact 40*a* is in an opened state (a current limiting state), and the second movable contact 40*b* is kept in an input state.

When a current limiting is performed, since interruption is performed not by the switching mechanism, the link 58, the link pin 59, the upper holder 55 and the side holder 50 are maintained at their positions when inputting.

The first movable contact 40*a* is in an opened state by an electromagnetic repulsive force with the fixed contact 10. The second movable contact 40*b* is maintained in a state of being in contact with the fixed contact 10.

The pressurizing protrusion 45*a* of the first movable contact 40*a* is in a state of escaping from the hook part 83 of the catch 80, and the pressurizing protrusion 45*b* of the second movable contact 40*b* is in a state of being in contact with the inner surface of the base plate 81 of the catch 80.

A procedure in which current limiting interruption occurs in only one movable contact 40 will be described in detail with reference to FIGS. 9 to 12.

Figure 9:
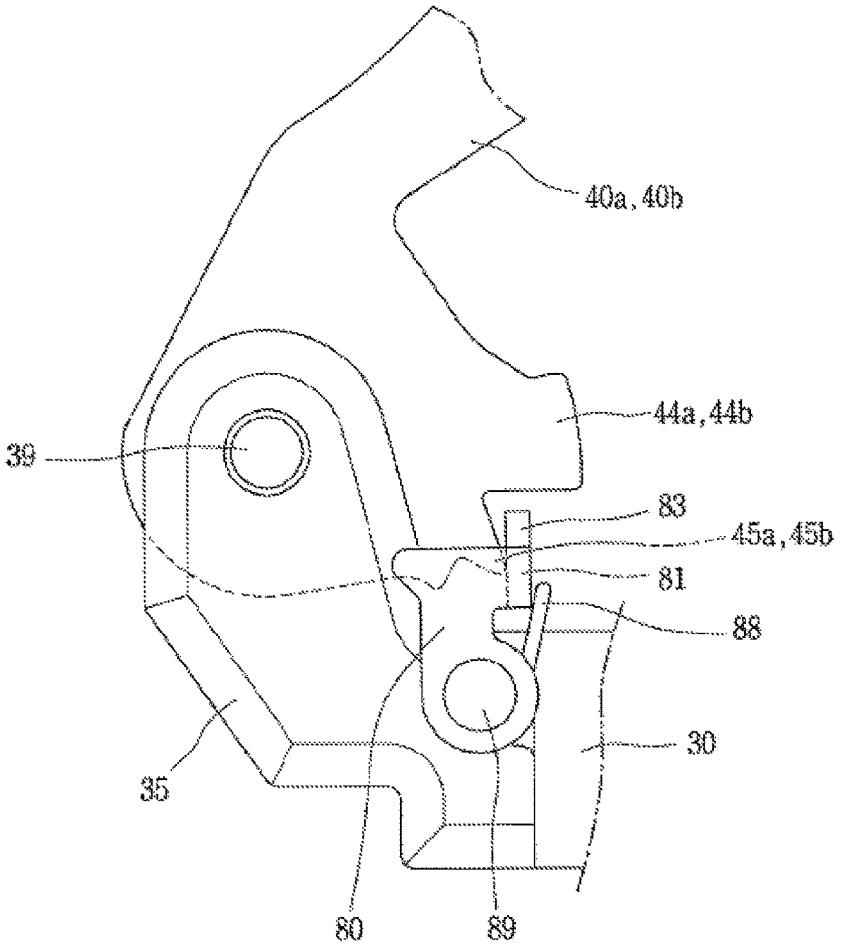
FIG. 9, FIG. 10, FIG. 11 and FIG. 12 are a detailed operational diagram of FIG. 8 and are a partially detailed diagram illustrating surroundings of a catch.

FIG. 9 shows an input state. The catch 80 is in a state (position) in which the inner surface of the base plate 81 is in contact with each of pressurizing protrusions 45*a* and 45*b* of the movable contacts 40*a* and 40*b*.

Figure 10:
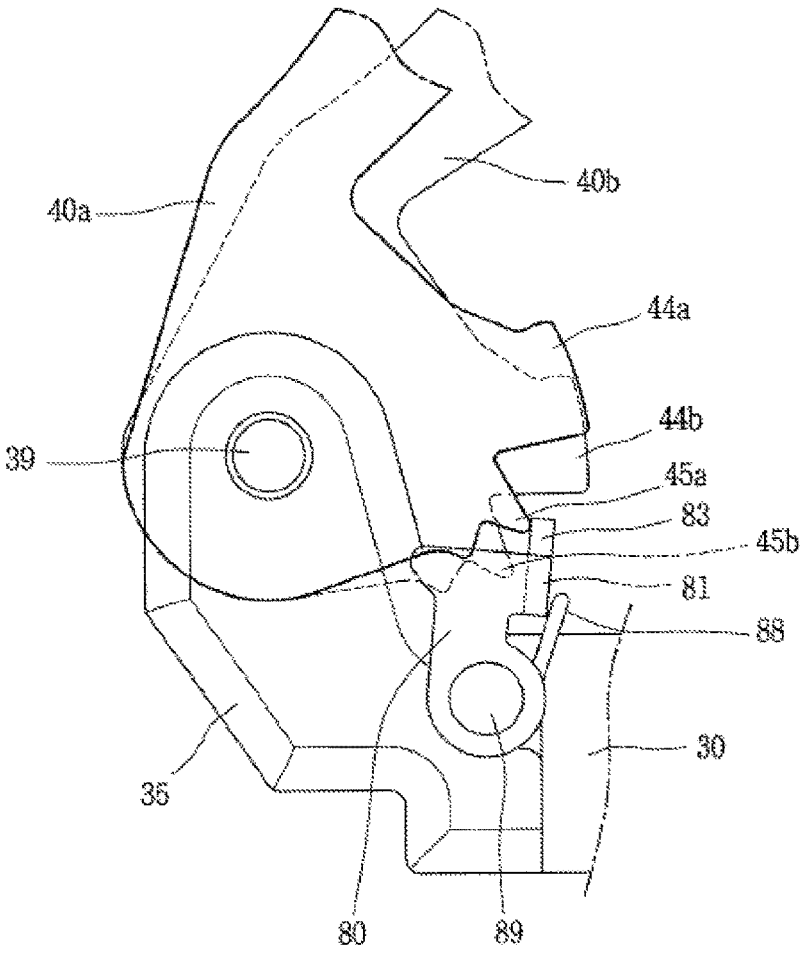

FIG. 10 shows a state in which current limiting interruption occurs in only the first movable contact 40*a* and thus the first movable contact 40*a* escapes from fixed contact 10. As the first movable contact 40*a* is pivoted in the counterclockwise direction, the pressurizing protrusion 45*a* of the first movable contact 40*a* pushes the catch 80. The catch 80 is pivoted in the clockwise direction. At this point, the catch 80 is temporarily separated from the second movable contact 40*b*.

Figure 11:
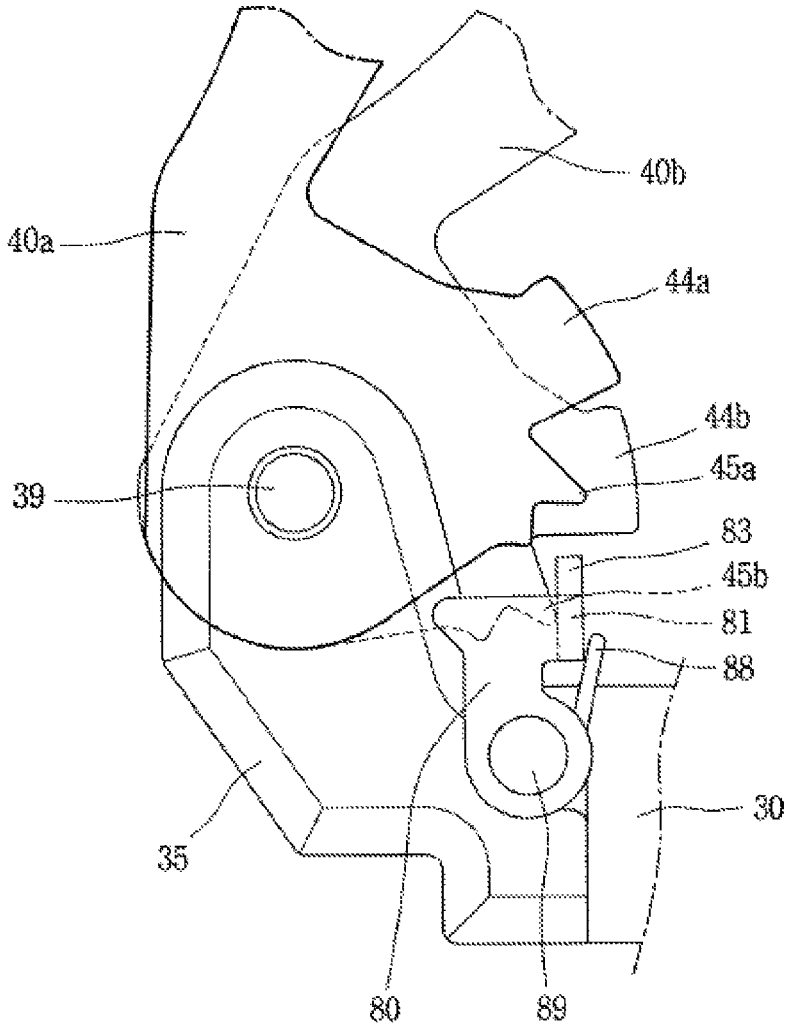

A description will be made with reference to FIG. 11. When the first movable contact 40*a* is further pivoted, the pressurizing protrusion 45*a* of the first movable contact 40*a* escapes from the hook part 83 of the catch 80, and the catch 80 is pivoted in the counterclockwise by a restoring force of the torsion spring 88, such that the inner surface of the base plate 81 of the catch 80 comes into contact with the pressurizing protrusion 45*b* of the second movable contact 40*b*. FIG. 11 shows that the first movable contact 40*a* is in an opened state and the second movable contact 40*b* is kept in an input state as shown in FIG. 8.

Figure 12:
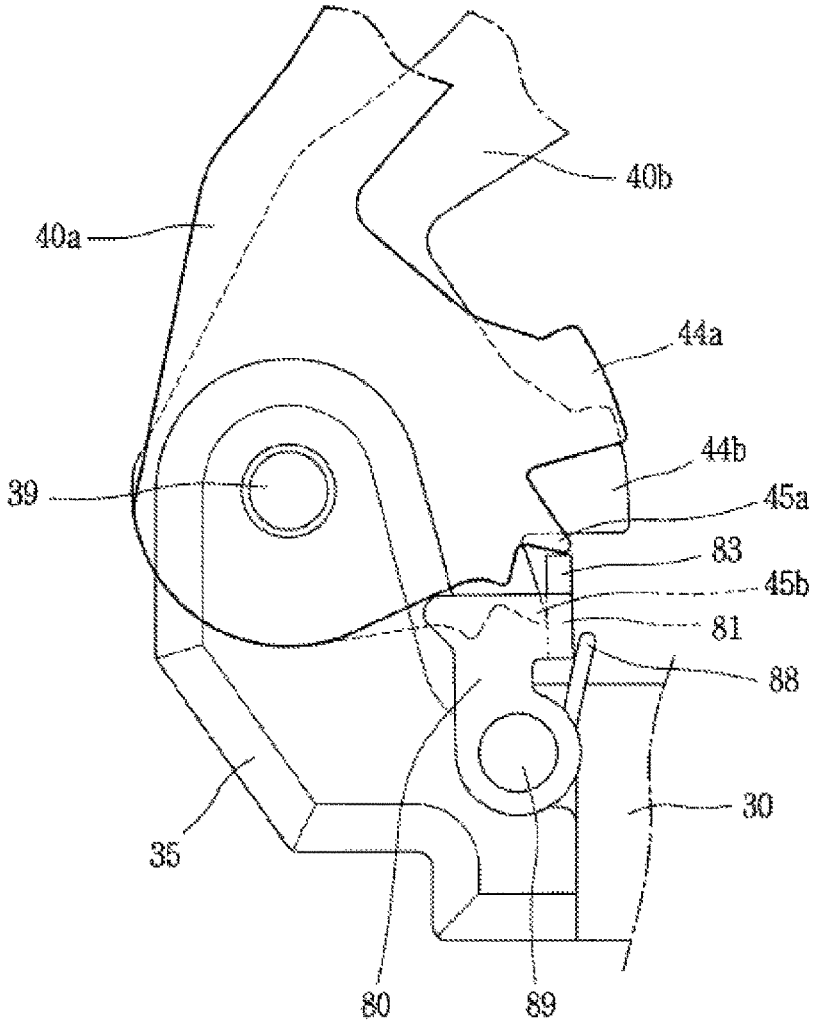

A description will be made with reference to FIG. 12. When an electromagnetic repulsive force is very strong between the first movable contact 40*a* and the fixed contact 10, the upper portion of the first movable contact 40*a* collides with a case or base mold, and thus a rebound phenomenon is caused by a repulsive force due to the collision. However, even when the first movable contact 40*a* is pivoted in the clockwise direction, the lower surface of the pressurizing protrusion 45*a* comes into contact with the upper surface of the hook part 83 of the catch 80 such that a further pivot is restricted. Thus, the catch 80 prevents reinputting of the first movable contact 40*a*.

Consequently, the catch 80 may prevent reinputting even when only one movable contact 40 is opened.

Figure 13:
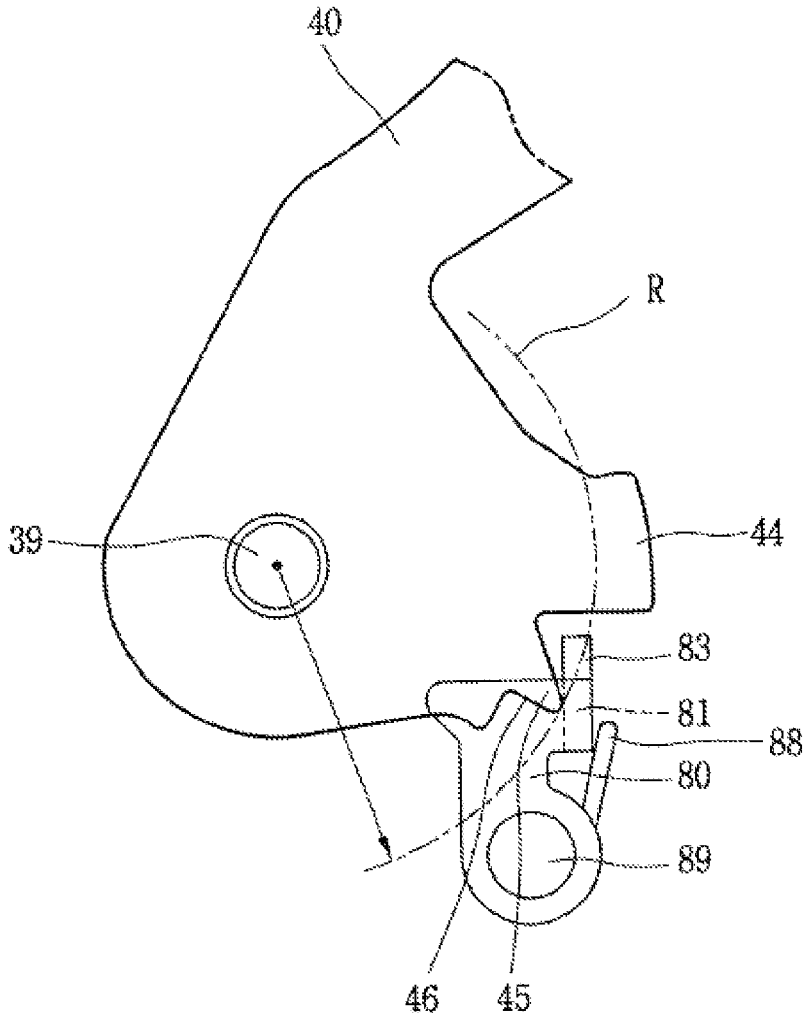
FIG. 13 is another detailed operational diagram of FIG. 8.

A relationship between the pressurizing protrusion 45 and the catch 80 will be described in more detail with reference to FIG. 13. FIG. 13 shows an input state.

In the input state, the hook part 83 of the catch 80 is in a state of being positioned (inputted) into an inner side of a pivotal circumferential surface R of an edge of the pressurizing protrusion 45. Therefore, when the pressurizing protrusion 45 returns by the rebound phenomenon after the pressurizing protrusion 45 pushes out the catch 80 due to the current limiting interruption, a lower surface 46 of the pressurizing protrusion 45 is hooked on the upper surface of the hook part 83 of the catch 80.

Among the embodiments according to the present invention, the action of the catch 80 is not separately described for all the movable contacts 40 when the current limiting interruption occurs, but when the rebound phenomenon occurs, reinputting of all the movable contacts 40 is further prevented.

In accordance with a movable contact assembly for a circuit breaker according to one embodiment of the present invention, when current limiting interruption occurs in any one of a plurality of movable contacts, a catch operation is performed to prevent reinputting. A pressurizing protrusion provided at a lower portion of each of the plurality of movable contacts pushes the catch when the current limiting interruption occurs and the catch returns by a torsion spring, such that reinputting is prevented even when a rebound phenomenon occurs in any one of the plurality of movable contacts.

Although the embodiments have been described with reference to illustrative embodiments of the present invention, it should be understood that numerous alternations and modifications can be devised by those skilled in the art to which the present invention pertains without departing from the essential features of the present invention. The embodiments disclosed herein, therefore, are not to be taken in a sense for limiting the technical concept of the present disclosure but for explanation thereof, and the range of the technical concept of the present invention is not limited to these embodiments. That is, the scope of the present invention should be construed by the appended claims, along with the full range of equivalents to which such claims are entitled.

What is claimed is:

1. A movable contact assembly for a circuit breaker, comprising: a fixed contact; a connector formed to protrude from one side of a terminal connected to a load or a power source; a plurality of movable contacts pivotably installed at the connector through a connector pin and configured to be contactable to or separable from the fixed contact; a side holder pivotably installed at the connector through the connector pin; a catch pivotably installed at the connector, supported on the side holder, and configured to restrict a rebound phenomenon of the plurality of movable contacts when current limiting interruption occurs; and a pressurizing protrusion formed at a lower portion of each of the plurality of movable contacts and configured to push the catch when the current limiting interruption occurs; wherein a latch is pivotably installed at an intermediate portion of the side holder, a latch support to which the latch is contactable is formed to protrude from one side of the lower portion of each of the plurality of movable contacts, and the pressurizing protrusion is formed at a lower portion of the latch support.

2. The movable contact assembly of claim 1, wherein the pressurizing protrusion is formed in a triangular shape.

3. The movable contact assembly of claim 2, wherein, in an opened state, a lower surface of the pressurizing protrusion is formed in a horizontal surface and an oblique surface thereof is formed in an inclined surface.

4. The movable contact assembly of claim 3, wherein an angle of the oblique surface is formed in a range of 30 to 60 degrees relative to the lower surface.

5. The movable contact assembly of claim 1, wherein the catch includes:

a base plate formed to have a length across the connector;

a side plate formed to be bent on both sides of the base plate;

a hook portion protruding from an upper portion of the base plate; and a hook protrusion protruding from an upper end of the side plate.

6. The movable contact assembly of claim 5, wherein a circumferential protrusion and a circumferential recess are formed along a circumferential surface at a lower end of the side holder.

7. The movable contact assembly of claim 6, wherein an angle between the hook protrusion and an upper end of the circumferential protrusion based on the connector pin is greater than an angle between the hook portion and the pressurizing protrusion based on the connector pin.

8. The movable contact assembly of claim 5, wherein, in an input state, the hook portion is positioned inside a pivotal circumferential surface of the pressurizing protrusion.

* * * * *